US006577221B1

(12) United States Patent
Wang

(10) Patent No.: US 6,577,221 B1
(45) Date of Patent: Jun. 10, 2003

(54) SAFETY SWITCH

(76) Inventor: Ming-Shan Wang, No. 16, Alley 25, Lane 127, Lin Sen Road, Kweishan Hsiang, Taoyuan Hsien (TW)

( * ) Notice: Subject to any disclaimer, the term of this patent is extended or adjusted under 35 U.S.C. 154(b) by 39 days.

(21) Appl. No.: 09/996,984

(22) Filed: Nov. 30, 2001

(51) Int. Cl.[7] ..... H01H 71/16; H01H 71/58; H01H 37/02

(52) U.S. Cl. ..... 337/59; 337/66; 337/52; 337/37; 200/339

(58) Field of Search ..... 337/1, 31, 12–16, 337/36, 37, 52, 53, 59, 62, 66, 68, 72, 75, 85, 89, 101, 111, 112, 113, 140; 200/401, 402, 451, 237, 318.1, 318.2, 339–341; 29/622

(56) References Cited

U.S. PATENT DOCUMENTS 4,337,450 A * 6/1982 Matthies ..... 337/102
5,262,748 A * 11/1993 Tsung-Mou ..... 337/66
5,498,846 A * 3/1996 Chin ..... 200/553
5,539,371 A * 7/1996 Yu ..... 337/66
5,694,106 A * 12/1997 Wang ..... 337/53
5,760,672 A * 6/1998 Wang ..... 337/66
5,828,284 A * 10/1998 Huang ..... 337/112
5,847,638 A * 12/1998 Sorenson ..... 200/553
5,892,426 A * 4/1999 Huang ..... 337/334
5,898,355 A * 4/1999 Yu ..... 337/8
5,933,069 A * 8/1999 Huang ..... 337/66
6,072,381 A * 6/2000 Yu ..... 337/112
6,121,868 A * 9/2000 Chiang ..... 337/37
6,275,133 B1 * 8/2001 Chen ..... 337/37
6,400,250 B1 * 6/2002 Wang ..... 337/66
6,452,125 B1 * 9/2002 Yu ..... 200/553
6,483,416 B2 * 11/2002 Yu ..... 337/126

FOREIGN PATENT DOCUMENTS

CH 647094 A * 12/1984 ..... H01H/71/16
JP 2001006513 A * 1/2001 ..... H01H/73/22
JP 2001006514 A * 1/2001 ..... H01H/73/22

* cited by examiner

*Primary Examiner*—Anatoly Vortman
(74) *Attorney, Agent, or Firm*—Rosenberg, Klein & Lee

(57) ABSTRACT

A safety switch is constructed to include two metal contact plates, a bimetal contact plate suspended from one metal contact plate, a switching handle, a push and pull bar pivoted to the switching handle and driven by the switching handle to move the bimetal contact plate between the "On" position and the "Off" position, and a S-shaped metal spring plate adapted for supporting and guiding movement of the push and pull bar for enabling the bimetal contact plate to trip off automatically upon an overload despite of the positioning of the push and pull bar or the switching handle.

4 Claims, 13 Drawing Sheets

ON

ON

SAFETY SWITCH

BACKGROUND OF THE INVENTION

1. Field of the Invention

The present invention relates to a safety switch and, more particularly, to such a safety switch, which uses a S-shaped metal spring plate to guide and support a push and pull bar, enabling the On/Off control bimetal contact plate to automatically trip off upon an overload.

2. Description of the Related Art

FIG. 7 shows a conventional seesaw switch, which comprises a switching handle 11 (which has a lamp bulb installed therein), and a press rod 110 supported on a spring in a bottom hole of the switching handle 11 and moved with the switching handle 11 to move a movable metal contact plate 12 between the "On" position and the "Off" position. This structure of seesaw switch is a passive switch that cannot automatically trip off upon an overload. When an overload occurred, the circuit tends to be burned out. In order to eliminate this problem, switches with protective circuit means, i.e., safety switches are developed. FIGS. 8A and 8B show a safety switch according to the prior art. This structure of safety switch comprises a housing 10, a switching handle 13 pivoted to the housing 10, three metal contact plates, namely, the first metal contact plate 15, the second metal contact plate 16, and the third metal contact plate 17 respectively installed in the bottom side of the housing 10, a bimetal contact plate 170, the bimetal contact plate 170 having a fixed end fixedly fastened to the third metal contact plate 17 and a free end provided with a contact 171 adapted for contacting a contact 160 at the second metal contact plate 16 to close the circuit, a link 14 coupled between one end of the switching handle 13 and the free end of the bimetal contact plate 170 and driven by the switching handle 13, to move the contact 171 of the bimetal contact plate 170 toward or away from the contact 160 of the second metal contact plate 16, and a curved spring plate 18 fixedly connected between one peripheral sidewall of the housing 10 and the free end of the bimetal contact plate 170 and adapted for controlling the moving distance of the free end of the bimetal contact plate 170. When the temperature of the bimetal contact plate 170 surpasses a predetermined high value due to an overload, it is caused to deform and to trip off from the contact 160 of the second metal contact plate 16. This structure of safety switch is still not satisfactory in function because of the following drawbacks:

1. When the switching handle 13 jammed or stopped by an external pressure, or the curved spring plate 18 was worn-out, the bimetal contact plate 170 cannot trip off upon an overload.
2. The bimetal contact plate 170 automatically trips off when the temperature surpassed a trip-off temperature (normally 100°~150° C.). When turning the switching handle 13 to the "On" position at this time, the bimetal contact plate 170 will automatically trip off if the power of deformation of the bimetal contact plate 170 surpasses the spring power of the curved spring plate 18. If the user holds the switching handle 13 in the "On" position with force to keep the contact 171 of the bimetal contact plate 170 in contact with the contact 160 of the second metal contact plate 16 at this time, the circuit may be caused to burn out.
3. Because the bimetal contact plate 170 is a planar structure for one-way trip-off functioning only, the curved spring plate 18 must be used to achieve bi-directional trip-off functioning. However, it is difficult to control the spring power of the curved spring plate 18 during its fabrication. If the spring power of the curved spring plate 18 does not match, the bimetal contact plate 170 will be unable to function normally.

FIGS. 9A and 9B show a safety switch with overcurrent protection. This structure of safety switch comprises a switching handle 20, an electrically insulative driving element 21 and a link 22 coaxially pivoted to one end of the switching handle 20, a spring member 24 connected between a fixed point and the other end of the driving element 21, and a bimetal contact plate 23. The bimetal contact plate 23 has a fixed end fixedly fastened to a first metal contact plate connected to one terminal of power supply, and a free end connected to the other end of the link 22 and moved with the link 22 relative to a contact at a second metal contact plate connected to the other terminal of power supply. When an overcurrent occurred, the bimetal contact plate 23 is heated to deform and to trip off from the contact of the second metal contact plate, and at the same time the driving element 21 is moved upwards with the free end of the bimetal contact plate 23 and forced into engagement with a curved positioning portion 25 in the housing of the safety switch to hold the bimetal contact plate 23 in the "Off" position. This structure of safety switch still has drawbacks. If the switching handle 20, the driving element 21, or the link 21 fails to function normally, the bimetal contact plate 23 will be unable to trip off upon an overload. Further, the spring power of the spring member 24 must be accurately controlled during its fabrication. If the spring power of the spring member 24 does not match, the driving element 21 will be unable to function properly.

Therefore, it is desirable to provide a safety switch that eliminates the aforesaid drawbacks.

SUMMARY OF THE INVENTION

The present invention has been accomplished to provide a safety switch, which eliminates the aforesaid drawbacks. It is one object of the present invention to provide a safety switch, which automatically trips off upon an overload. It is another object of the present invention to provide a safety switch, which has a simple structure, and achieves the auto trip-off functioning of a conventional complicated fuseless mechanical switch. It is still another object of the present invention to provide a safety switch, which can be smoothly accurately switched between the "On" position and the "Off" position. To achieve these and other objects of the present invention, the safety switch comprises a housing holding two metal contact plates, which are respectively connected to the two opposite terminals of power supply, a bimetal contact plate suspended from one metal contact plate, a switching handle pivoted to the housing and adapted for moving the bimetal contact plate between the "On" position to close the circuit between the two metal contact plates and the "Off" position to open the circuit between the two metal contact plates, a push and pull bar pivoted to one end of the switching handle and driven by the switching handle to move the bimetal contact plate between the "On" position and the "Off" position, and a S-shaped metal spring plate adapted for supporting and guiding movement of the push and pull bar for enabling the bimetal contact plate to trip off automatically upon an overload despite of the positioning of the push and pull bar or the switching handle.

BRIEF DESCRIPTION OF THE DRAWINGS

FIG. 2 is a sectional view of the safety switch according to the first embodiment of the present invention when switched on.

FIG. 4(*b*) is sectional view in an enlarged scale of a part of the safety switch according to the first embodiment of the present invention showing the relative action between the push and pull bar and the bimetal contact plate (II).

FIG. 4(*c*) is sectional view in an enlarged scale of a part of the safety switch according to the first embodiment of the present invention showing the relative action between the push and pull bar and the bimetal contact plate (III).

FIG. 5(*b*) is sectional view in an enlarged scale of a part of the safety switch according to the second embodiment of the present invention showing the relative action between the push and pull bar and the bimetal contact plate (II).

FIG. 5(*c*) is sectional view in an enlarged scale of a part of the safety switch according to the second embodiment of the present invention showing the relative action between the push and pull bar and the bimetal contact plate (III).

FIG. 9B is similar to FIG. 9A but showing the safety switch switched on.

DETAILED DESCRIPTION OF THE PREFERRED EMBODIMENT

Figure 1:
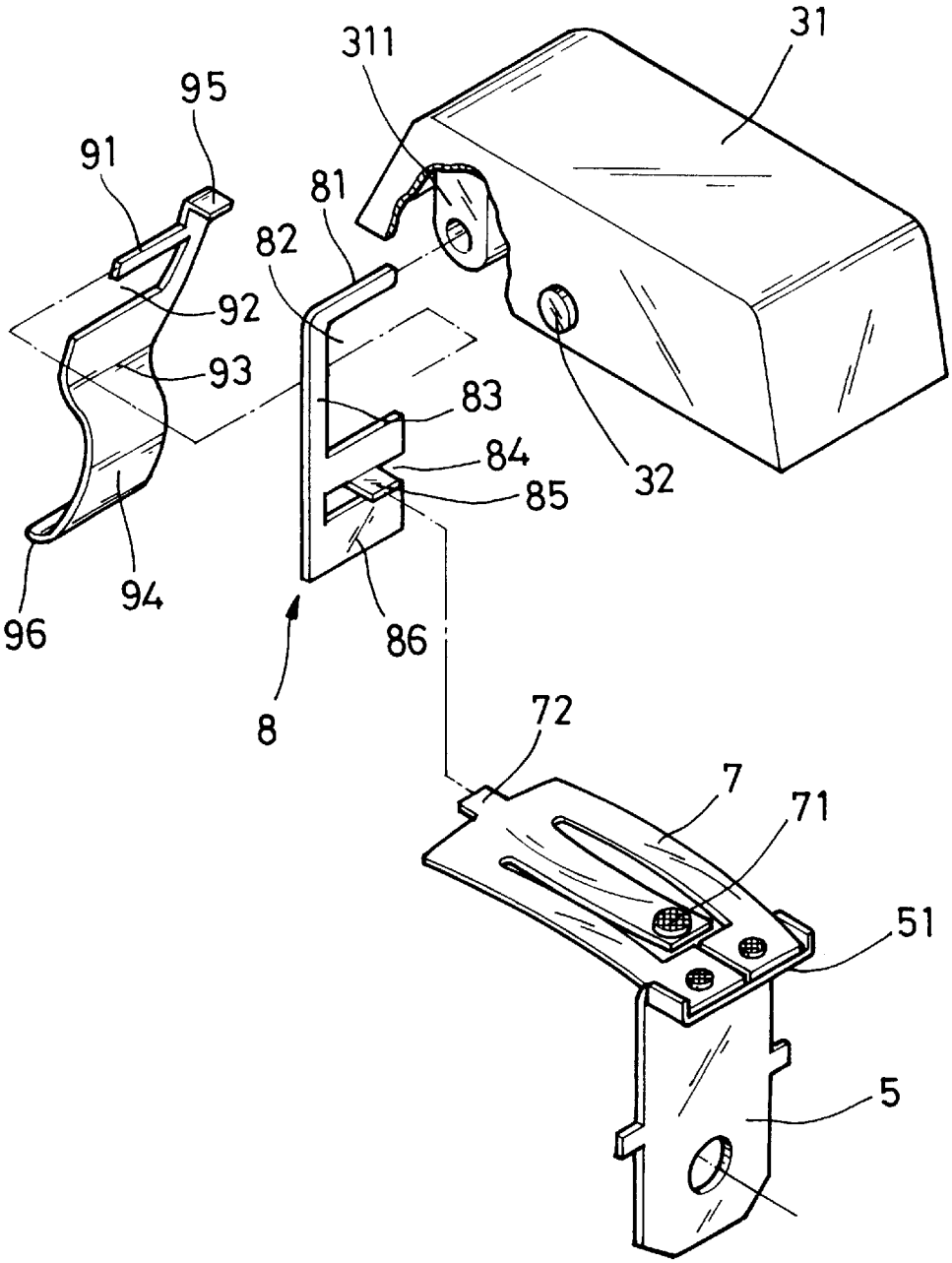
FIG. 1 is an exploded view of a part of a safety switch constructed according to a first embodiment of the present invention.
Figure 2:
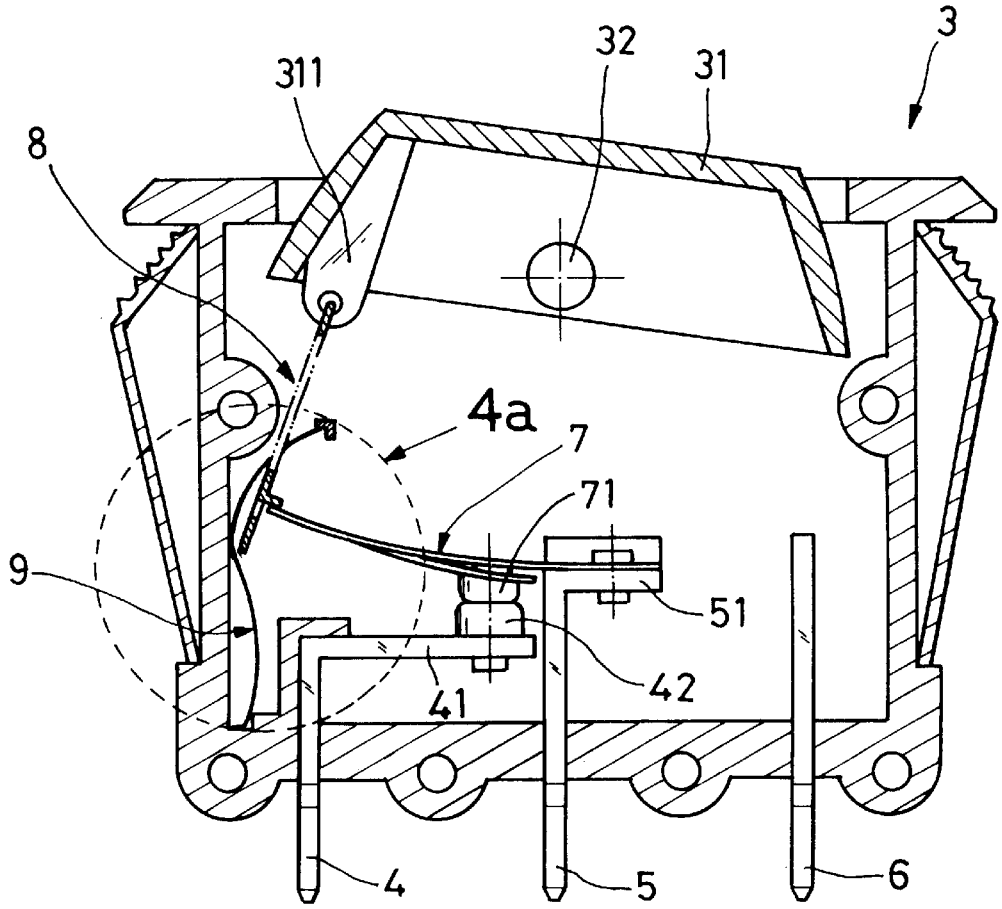
Figure 4A:
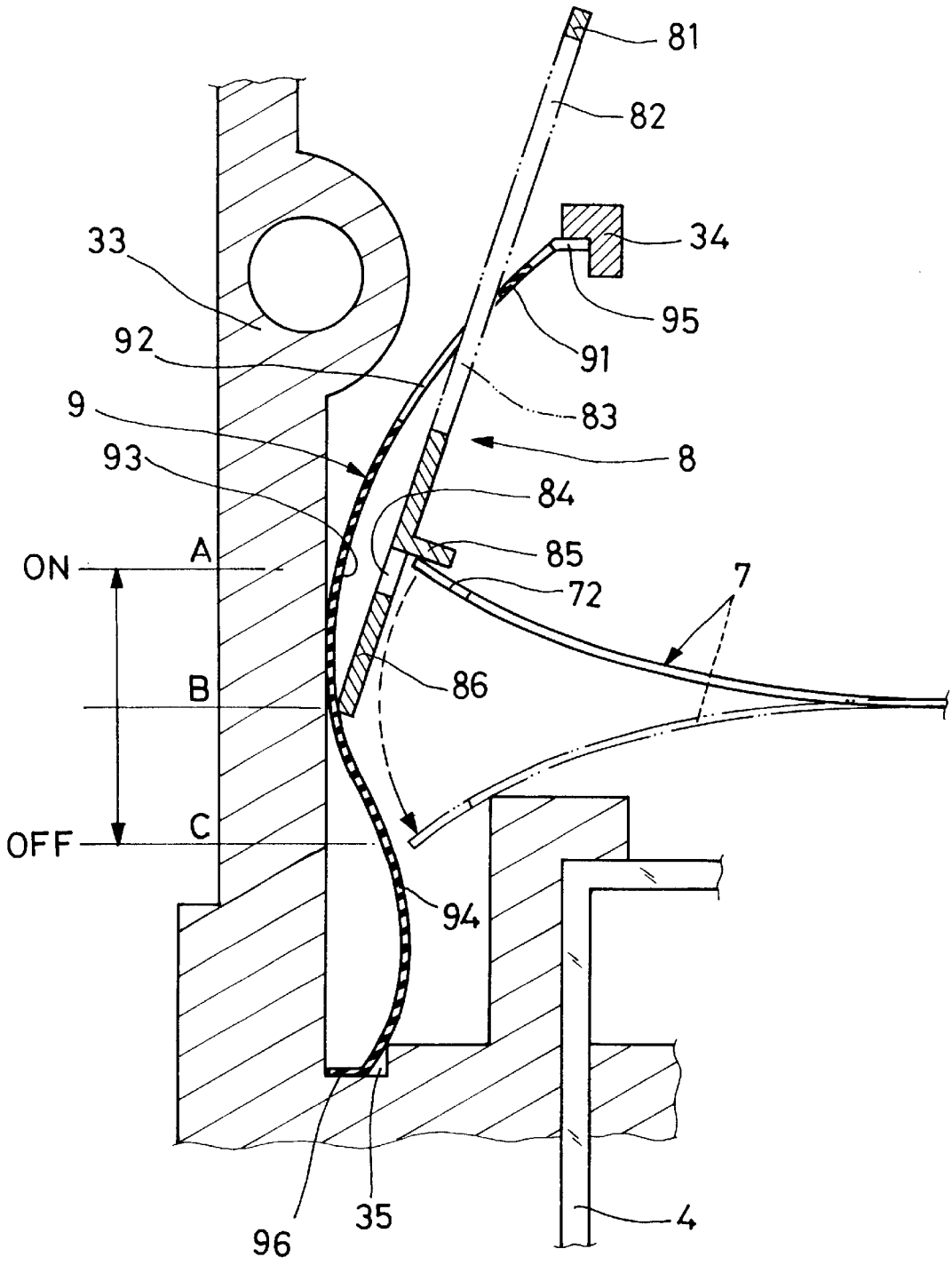
FIG. 4(*a*) is sectional view in an enlarged scale of a part of the safety switch according to the first embodiment of the present invention showing the relative action between the push and pull bar and the bimetal contact plate (I).
Figure 4B:
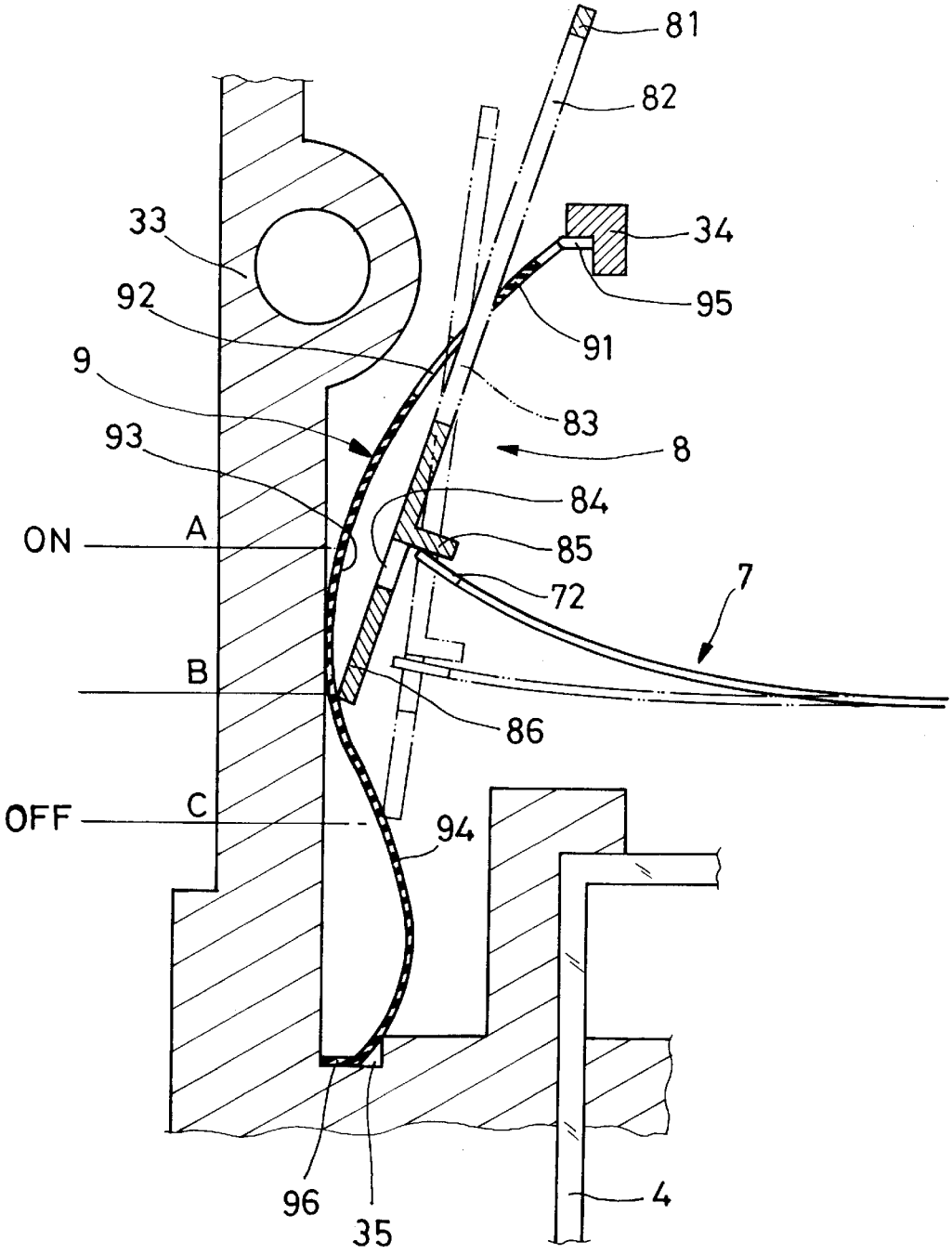
Figure 4C:
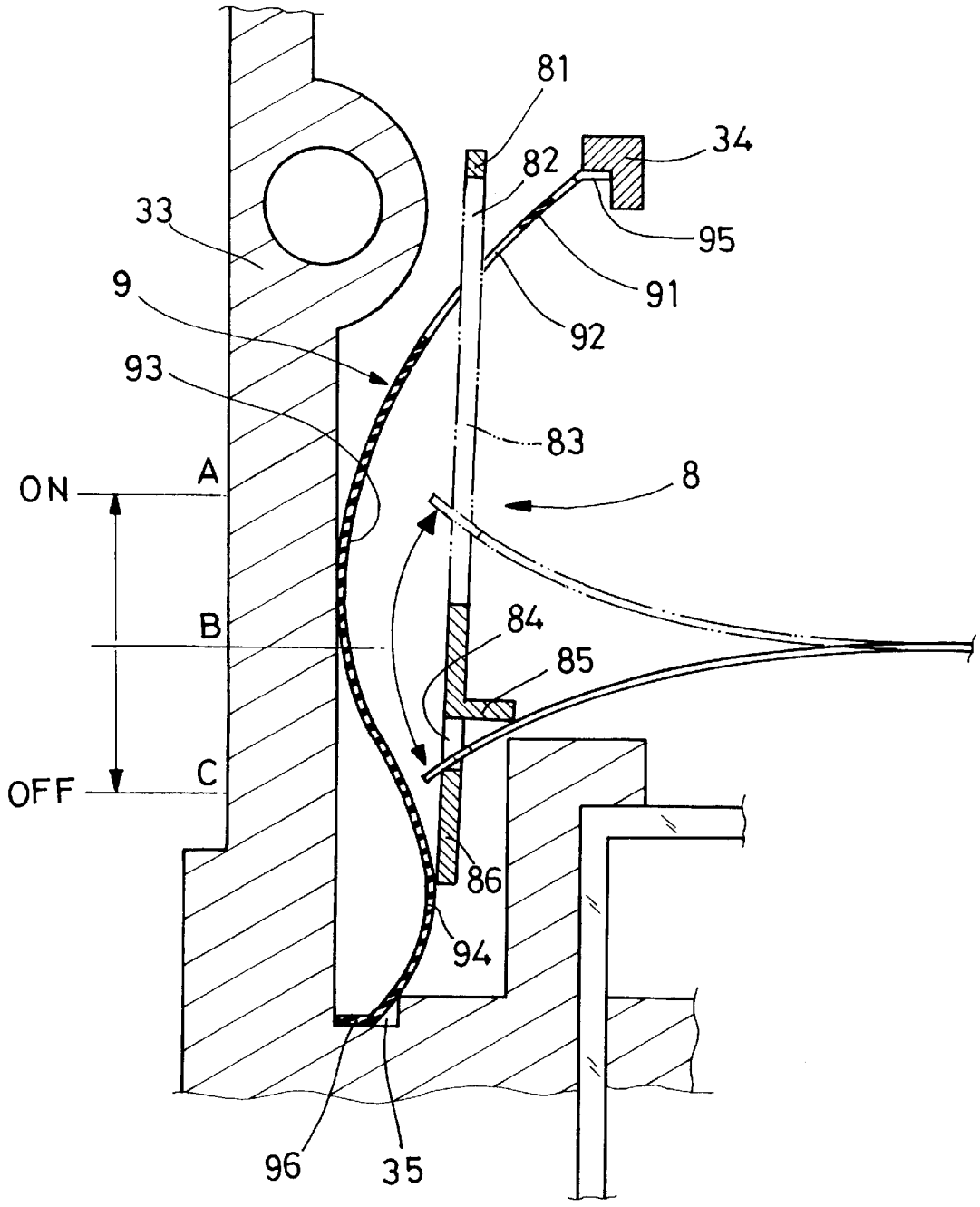

Referring to FIGS. 1, 2, and 4(*c*), a safety switch is shown comprising:

a housing 3;

a switching handle 31 suspended in the top open side of the housing 3 and adapted for switching on/off the safety switch, the switching handle 31 having two pivots 32 respectively raised from two opposite peripheral sidewalls thereof on the middle and respectively pivoted to the two opposite peripheral sidewalls of the housing 3, and a bottom lug 311 disposed near one end thereof;

a first metal contact plate 4 and a second metal contact plate 5 mounted in the housing 1 and respectively connected to the two opposite terminals of power supply, the first metal contact plate 4 having a horizontal top section 41 and a raised contact 42 at the top side of the horizontal top section 41, the second metal contact plate 5 having a horizontal top lug 51;

a bimetal contact plate 7 fastened to the horizontal top lug 51 of the second metal contact plate 5, the bimetal contact plate 7 having a contact 71 on the middle and a tip 72 protruded from the free end thereof;

a third metal contact plate 6 installed in the housing 3 and extended out of a bottom hole (not shown) of the housing 3 for grounding; and a push and pull bar 8 coupled between the switching handle 31 and the bimetal contact plate 7, the push and pull bar 8 comprises a horizontal top pin 81 pivoted to the bottom lug 311 of the switching handle 31, a horizontal bottom rail 86, a vertical actuating face 83 connected between one end of the horizontal top pin 81 and one end of the horizontal bottom rail 86, a side opening 82 defined between the horizontal top pin 81 and the horizontal bottom rail 86, a retaining gap 84 spaced between the side opening 82 and the horizontal bottom rail 86, and a protruded pushing rod 85 suspended above the retaining gap 84 below the side opening 82.

The main features of the present invention are outlined hereinafter. A substantially S-shaped metal spring plate 9 is mounted in one peripheral sidewall of the housing 3 within the path of the push and pull bar 8. The metal spring plate 9 comprises a top positioning flange 95 and a bottom positioning flange 96 respectively extended from the top and bottom ends thereof and fastened to respective positioning portions 34 and 35 of the housing 3, a first bearing portion 91 disposed near the top positioning flange 95 corresponding to the upper limit position ("On" position) of the push and pull bar 8, a side opening 92 defined below the horizontal bearing portion 91, a smoothly arched middle portion 93, and a second bearing portion 94 spaced between the smoothly arched middle portion 93 and the bottom positioning portion 96 corresponding to the lower limit position ("Off" position) of the push and pull bar 8. The side opening 92 of the S-shaped metal spring plate 9 extends in direction reversed to the side opening 82 of the push and pull bar 8. During installation, the push and pull bar 8 is inserted through the side opening 92 of the S-shaped metal spring plate 9, and moved up and down in the side opening 92 of the S-shaped metal spring plate 9 between the upper limit ("On") position and the lower limit ("Off") position.

When the bimetal contact plate 7 is maintained in the electrically connected "On") position as shown in FIGS. 2 and 4(*a*), the front (free) end of the bimetal contact plate 7 curves upwards, the first bearing portion 91 of the S-shaped metal spring plate 9 imparts a pressure to the push and pull bar 8, thereby causing the push and pull bar 8 to be tilted in one direction and supported on the second bearing portion 94 of the S-shaped metal spring plate 9, at this time the tip 72 of the bimetal contact plate 7 is disengaged from the retaining gap 84 but maintained stopped below the protruded pushing rod 85 of the push and pull bar 8, i.e., the contact 71 of the bimetal contact plate 7 is maintained in close contact with the contact 42 of the first metal contact plate 4, and the safety switch is maintained in the close circuit ("On") status. If the temperature of the bimetal contact plate 7 surpassed the predetermined critical level due to an overload during working of the safety switch, the bimetal contact plate 7 is caused to break down and to move from the position A to the position C, thereby causing the safety switch to be switched off.

Referring to FIG. 4(*b*), when pressing the switching handle 31 from the "On" position to the "Off" position, the protruded pushing rod 85 is lowered with the push and pull bar 8 to force the tip 72 of the bimetal contact plate 7 downwards. When the tip 72 of the bimetal contact plate 7 lowered below the mid point (trip-off) position B between the "On" position A and the "Off" position C, the bimetal contact plate 7 is deformed and tripped to position C to off the circuit.

Figure 3:
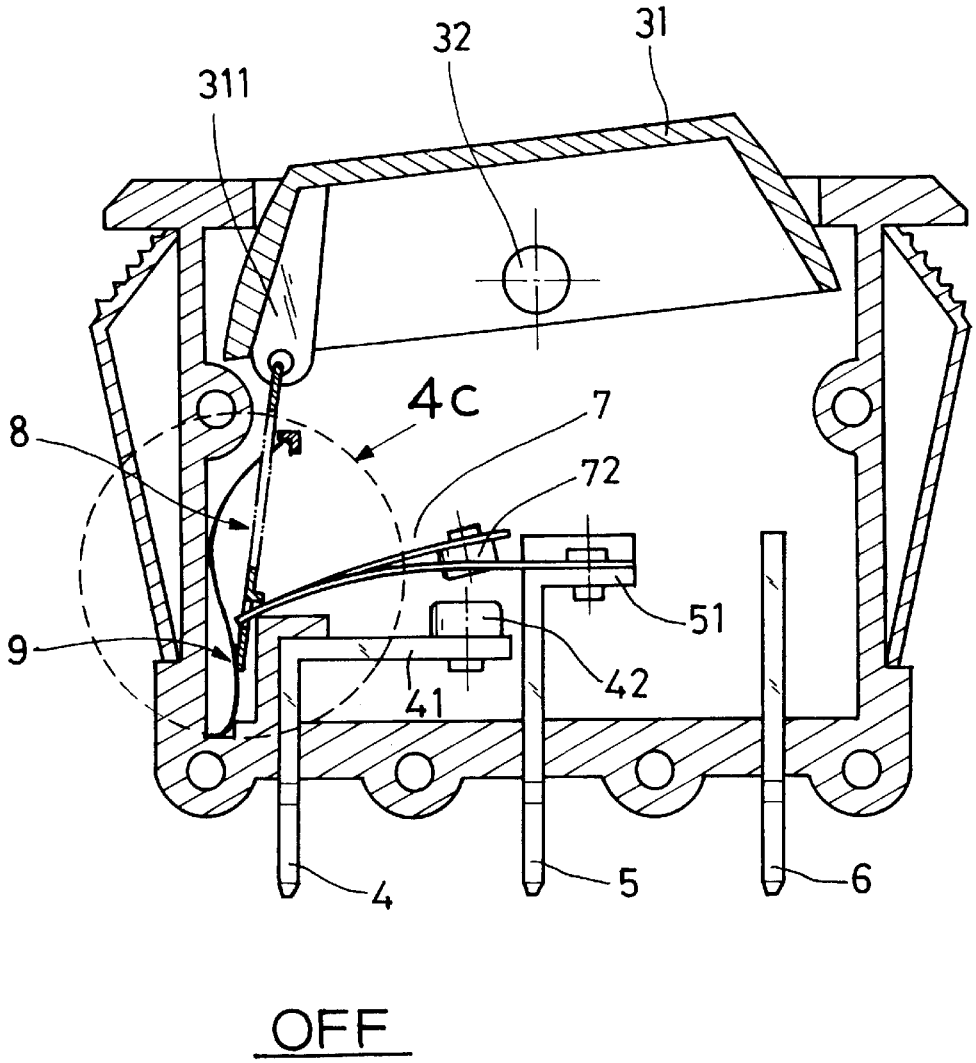
FIG. 3 is a sectional view of the safety switch according to the first embodiment of the present invention when switched off.

After trip off of the bimetal contact plate 7 due to breakdown, the switching handle 31 is turned with the hand in the reversed direction to switch on the safety switch. At this time, the push and pull bar 8 is forced downwards and moved along the smoothly arched middle portion 93 of the S-shaped metal spring plate 9 to the second bearing portion 94 as shown in FIGS. 3 and 4(*a*), and the tip 72 of the bimetal contact plate 7 is forced into the retaining gap 84 of the pus and pull bar 8, and therefore the bimetal contact plate 7 is linked to the push and pull bar 8. Therefore, when the push and pull bar 8 lifted, the horizontal bottom rail 86 imparts a pressure to the tip 72 of the bimetal contact plate 7, causing the bimetal contact plate 7 to deform and to force the contact 71 into close contact with the contact 42 of the first metal contact plate 4, and therefore the safety switch is switched on. When the push and pull bar 8 moved upwards, the first bearing portion 91 of the S-shaped metal spring plate 9 touches the actuating face 83 of the push and pull bar 8 as shown in FIG. 4(*a*), thereby causing the push and pull bar 8 to be tilted in one direction, and the tip 72 of the bimetal contact plate 7 is disengaged from the retaining gap 84 of the pus and pull bar 8 and stopped below the protruded pushing rod 85 so that the bimetal contact plate 7 can quickly trip off upon an overload.

As indicated above, the push and pull bar 8 is moved along the inner surface of the S-shaped metal spring plate 9 between the "On" position and the "Off" position smoothly, enabling the switching handle 31 to be smoothly operated to switch on/off the safety switch accurately.

Figure 5A:
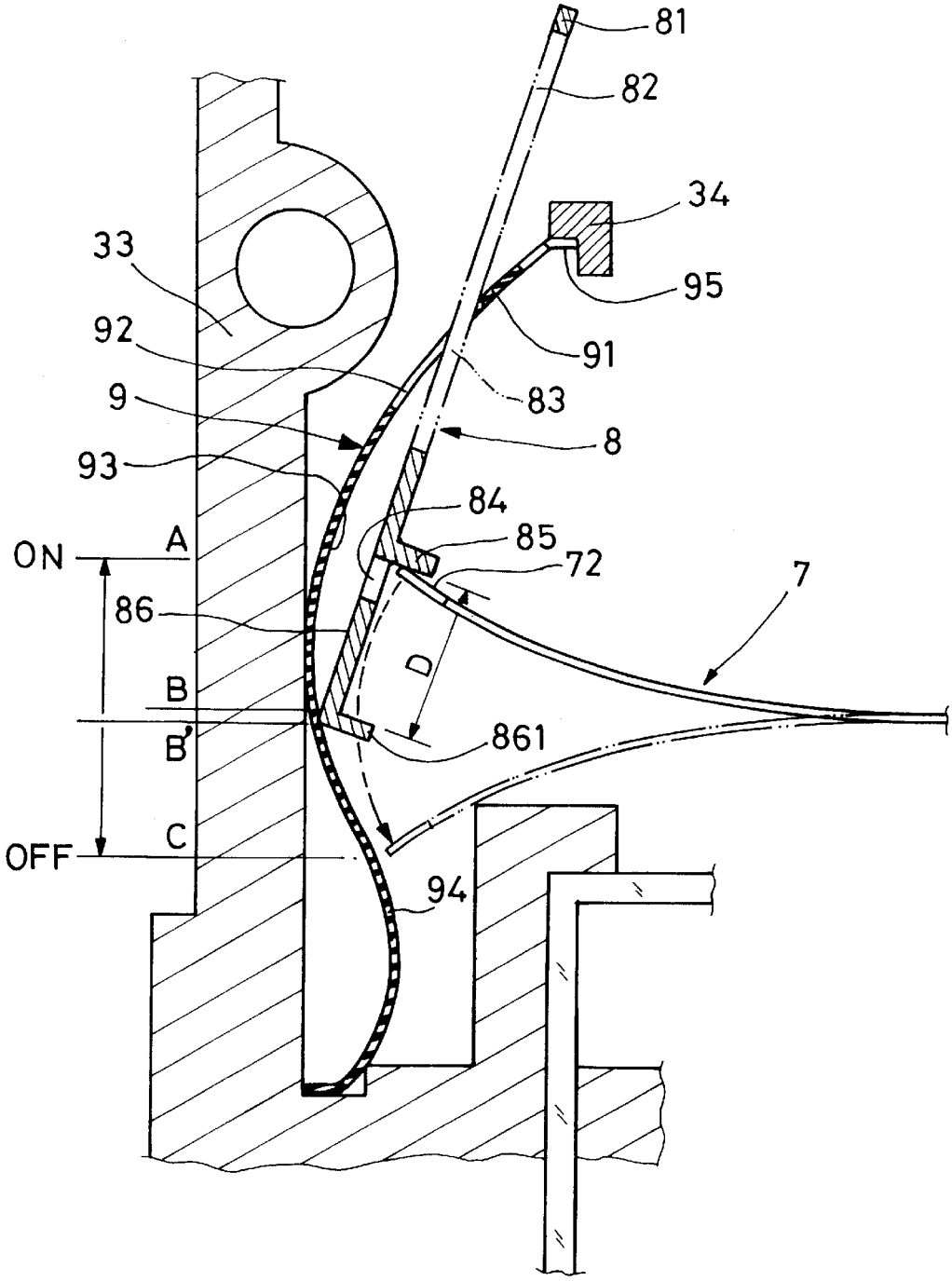
FIG. 5(*a*) is sectional view in an enlarged scale of a part of the safety switch according to the second embodiment of the present invention showing the relative action between the push and pull bar and the bimetal contact plate (I).
Figure 5B:
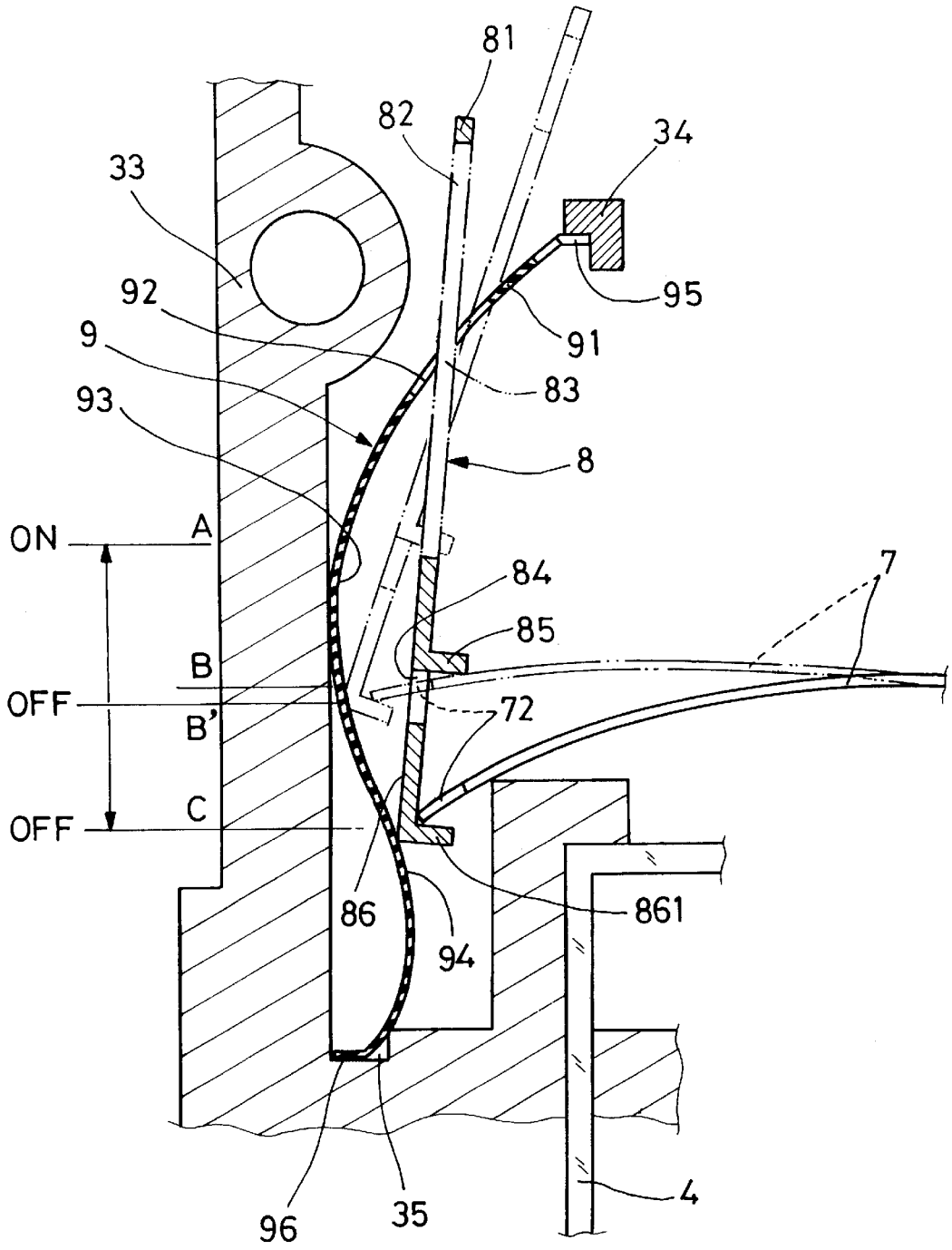
Figure 5C:
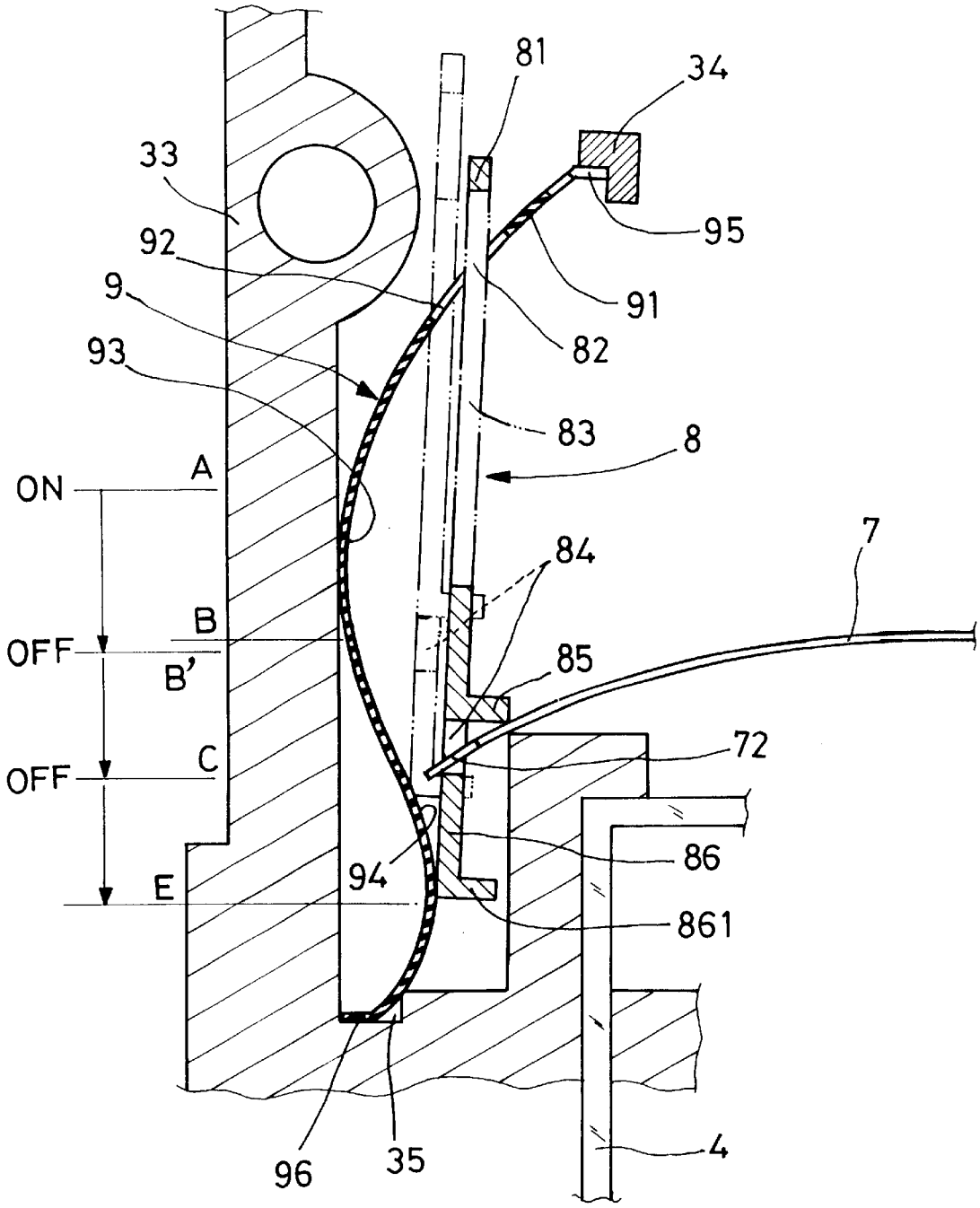

FIGS. 5(*a*) shows an alternate form of the present invention. According to this alternate form, the push and pull bar 8 comprises a L-shaped extension flange 861 extended from the bottom side of the horizontal bottom rail 86 and suspended in position B' below the mid point (trip-off) position B. The distance D between the protruded pushing rod 85 and the L-shaped extension flange 861 is sufficient for enabling the bimetal contact plate 7 to trip off. In case the push and pull bar 8 is jammed or damaged and unable to be moved, the bimetal contact plate 7 can still trip off to switch off the circuit.

Referring to FIG. 5(*b*), when the bimetal contact plate 7 broken down and tripped off during normal functioning of the push and pull bar 8 and the switching handle 31, the tip 72 of the bimetal plate 7 will carry the L-shaped extension flange 861 to the "Off" position C.

Figure 6:
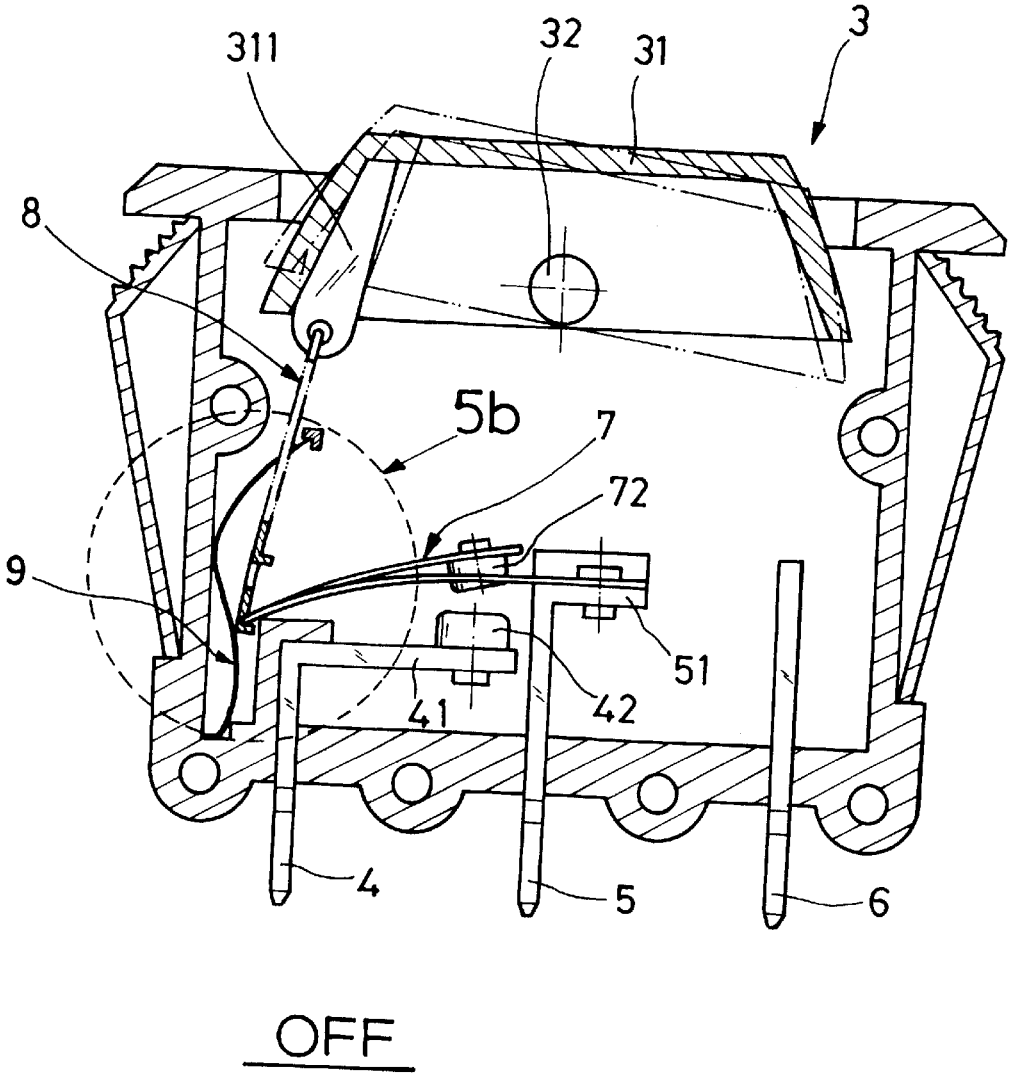
FIG. 6 is a sectional assembly view of the safety switch according to the second embodiment of the present invention, showing the bimetal contact plate tripped off, the switching handle turned to the horizontal position.
Figure 7:
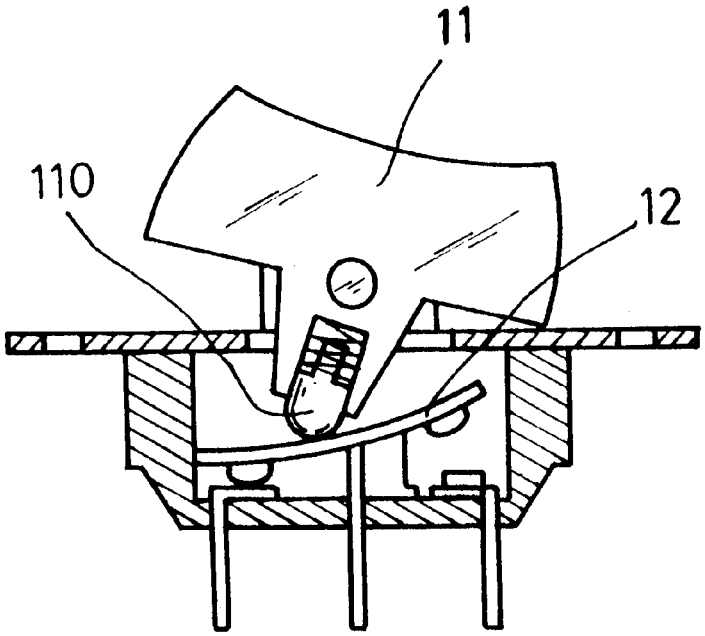
FIG.7 PRIOR ART
FIG. 7 is a sectional view of a seesaw switch constructed according to the prior art.
Figure 8A:
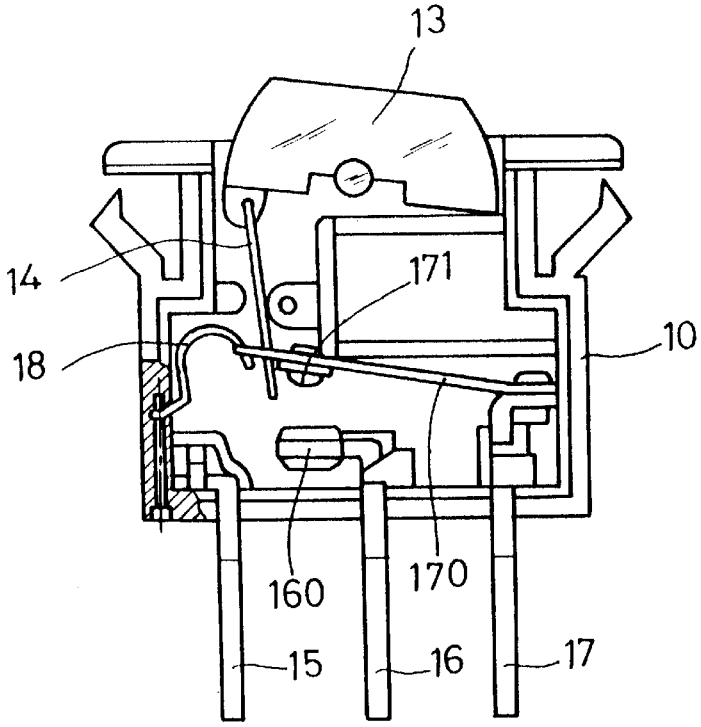
FIG. 8(A) PRIOR ART
FIG. 8A is a sectional view of a safety switch constructed according to the prior art when switched off.
Figure 8B:
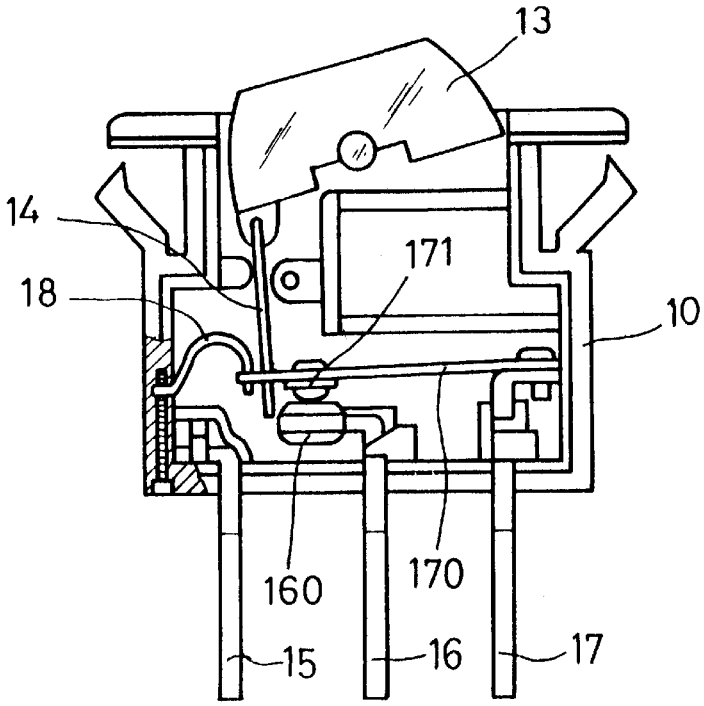
FIG. 8(B) PRIOR ART
FIG. 8B is similar to FIG. 8A but showing the safety switch switched off.
Figure 9A:
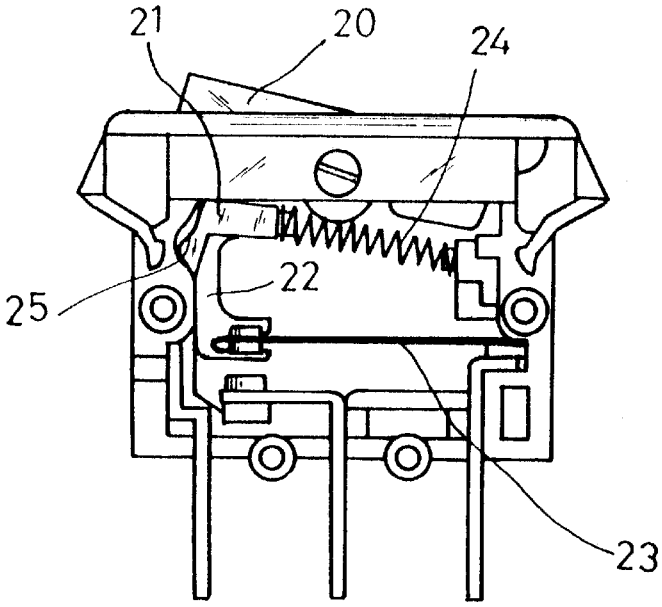
FIG. 9(A) PRIOR ART
FIG. 9A is a sectional view of another structure of safety switch constructed according to the prior art when switched off.
Figure 9B:
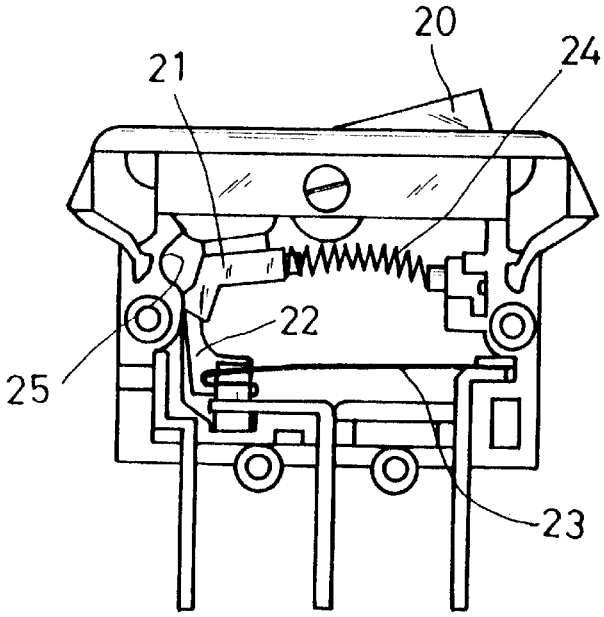
FIG. 9(B) PRIOR ART

Referring to FIG. 6, when the bimetal contact plate 7 tripped off and moved to the "Off" position C due to an overload, the push and pull bar 8 is moved with the bimetal contact plate 7 to the "Off" position C, and at this time the switching handle 31 is turned from the rightwards tilted position to the horizontal position. By means of the indication of the horizontal position of the switching handle 31, the user knows that the safety switch is not in the "On" position. If the user wishes to switch on the safety switch, press the switching handle 31 leftwards to lower the push and pull bar 8 from the "Off" position C to the position E. At this time, the second push portion 94 of the S-shaped metal spring plate 9 forces the horizontal bottom rail 86 of the push and pull bar 8 inwards, thereby causing the tip 72 of the bimetal contact plate 7 to be engaged into the retaining gap 84 of the pus and pull bar 8, and therefore the bimetal contact plate 7 is linked to the push and pull bar 8. When pressing the switching handle 31 rightwards, the push and pull bar 8 is lifted, and the bimetal contact plate 7 is curved again and moved from the "Off" position C to the "On" position A to switch on the circuit.

A prototype of safety switch has been constructed with the features of FIGS. 1~6. The safety switch functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A safety switch comprising:

a housing;

a switching handle pivoted to said housing and adapted for switching on/off the safety switch, said switching handle having two pivots respectively raised from two opposite peripheral sidewalls thereof on the middle and respectively pivoted to two opposite peripheral sidewalls of said housing, and a bottom lug disposed near one end thereof;

a first metal contact plate and a second metal contact plate mounted in said housing and respectively connected to two opposite terminals of power supply, said first metal contact plate having a horizontal top section and a raised contact at said horizontal top section, said second metal contact plate having a horizontal top lug;

a bimetal contact plate, said bimetal contact plate having a fixed end fixedly fastened to the horizontal top lug of said second metal contact plate, a contact adapted for contacting the contact of said first metal contact plate, and a free end terminating in a tip;

a push and pull bar coupled to said switching handle and moved with said switching handle between an upper limit ("On") position and a lower limit ("Off") position, said push and pull bar comprising a horizontal top pin pivoted to the bottom lug of said switching handle, and a horizontal bottom rail adapted for pulling the tip of said bimetal contact plate to force said bimetal contact plate to trip off, a vertical actuating face connected between one end of said horizontal top pin and one end of said horizontal bottom rail, a side opening defined between said horizontal top pin and said horizontal bottom rail, a retaining gap spaced between said side opening and said horizontal bottom rail and adapted for receiving the tip of said bimetal contact plate, and a protruded pushing rod suspended above said retaining gap below said side opening and adapted for pushing the top of said bimetal contact plate;

wherein a substantially S-shaped metal spring plate is mounted in one peripheral sidewall of said housing within the path of said push and pull bar between said upper limit ("On") position and said lower limit ("Off") position to guide movement of said push and pull bar, said S-shaped metal spring plate comprising a first bearing portion disposed near a top end thereof corresponding to said upper limit position ("On" position), a side opening defined below said horizontal bearing portion and adapted for receiving said push and pull bar, a smoothly arched middle portion, and a second bearing portion disposed near a bottom end thereof corresponding to said lower limit position ("Off" position) and adapted for supporting said push and pull bar.

2. The safety switch as claimed in claim 1, wherein the side opening of said S-shaped metal spring plate extends in direction reversed to the side opening of said push and pull bar.

3. The safety switch as claimed in claim 1, wherein said S-shaped metal spring plate further comprises a top positioning flange and a bottom positioning flange respectively extended from the top and bottom ends thereof and fastened to respective positioning portions of said housing.

4. The safety switch as claimed in claim 1 wherein said push and pull bar further comprises a L-shaped extension flange extended from a bottom side of said horizontal bottom rail and suspended in position below the mid point between said upper limit position ("On" position) and said lower limit position ("Off" position).

* * * * *